United States Patent [19]

Elkins, Jr.

[11] 4,128,242

[45] Dec. 5, 1978

[54] CORRELATED SET OF GOLF CLUBS

[75] Inventor: Vance V. Elkins, Jr., Freehold, N.J.

[73] Assignee: Pratt-Read Corporation, Ivoryton, Conn.

[21] Appl. No.: 631,165

[22] Filed: Nov. 11, 1975

[51] Int. Cl.[2] ..... A63B 53/00

[52] U.S. Cl. ..... 273/77 A

[58] Field of Search ..... 273/77 A, 167 F, 169, 273/171, 81 A, 80 A; 73/65

[56] References Cited

U.S. PATENT DOCUMENTS

| | | | |
|---|---|---|---|
| 1,351,768 | 9/1920 | Lawton | 273/77 A X |
| 1,516,786 | 11/1924 | Prentiss | 273/77 A |
| 1,594,801 | 8/1926 | Stackpole | 273/77 A |
| 1,665,523 | 4/1928 | Boyce | 273/77 A X |
| 1,742,394 | 1/1930 | Jacob et al. | 73/65 |
| 1,825,172 | 9/1931 | Barret | 73/65 |
| 1,982,087 | 11/1934 | Wantz | 273/80 A X |
| 2,307,877 | 1/1943 | Chapman | 73/65 |
| 2,349,736 | 5/1944 | Knobel et al. | 273/77 A X |
| 2,727,384 | 12/1955 | Brandon | 273/77 A X |
| 3,106,091 | 10/1963 | Korr | 273/77 A X |
| 3,473,370 | 10/1969 | Marciniak | 273/77 A X |
| 3,698,239 | 10/1972 | Everett | 73/65 |
| 3,722,887 | 3/1973 | Cochran et al. | 273/77 A |
| 3,845,960 | 11/1974 | Thompson | 273/167 F X |
| 3,871,649 | 3/1975 | Kilshaw | 273/77 A |
| 3,941,390 | 3/1976 | Hussey | 273/167 F X |
| 3,984,103 | 10/1976 | Nix | 273/77 A |
| 4,043,184 | 8/1977 | Sayers | 73/65 |

FOREIGN PATENT DOCUMENTS

| | | | |
|---|---|---|---|
| 128888 | 8/1948 | Australia | 273/77 A |
| 710688 | 6/1965 | Canada | 273/80 A |
| 1220804 | 1/1971 | United Kingdom | 273/77 A |
| 1261541 | 1/1972 | United Kingdom | 273/80 R |

OTHER PUBLICATIONS

"Instruments & Control Systems," Nov. 1966; pp. 85–89.

*Primary Examiner*—Richard J. Apley
*Attorney, Agent, or Firm*—Frailey & Ratner

[57] ABSTRACT

A correlated set of golf clubs in which each of the clubs in the set are dynamically correlated so that each club is matched in accordance with at least one dynamic criteria. Further, each club of the set is statically correlated as a function of the correlated dynamic criteria so that each of the clubs in the set is also matched in accordance with at least one static criteria. In this way, each club exhibits substantially the same static and dynamic force characteristics throughout an entire golf swing.

27 Claims, 18 Drawing Figures

FIG. 1A
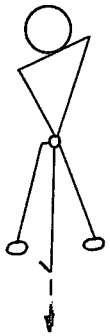
FIG. 1B
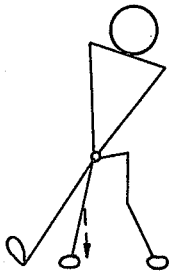
FIG. 1C
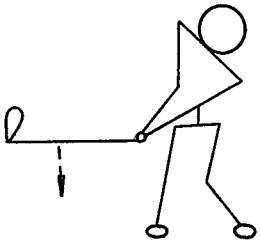
FIG. 1D
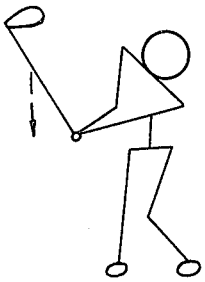
FIG. 1E
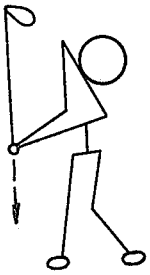
FIG. 1F
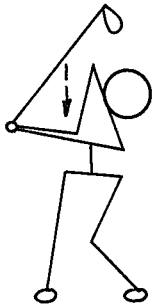
FIG. 1G
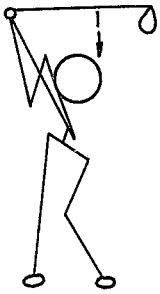
FIG. 1H
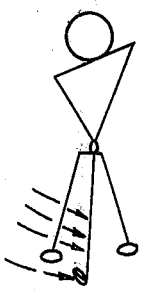
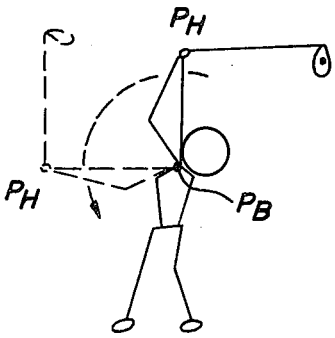
FIG. 2A
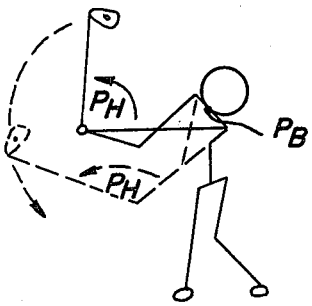
FIG. 2B
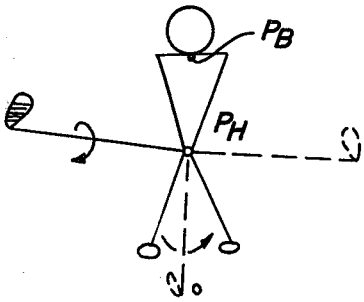
FIG. 2C FIG. 3
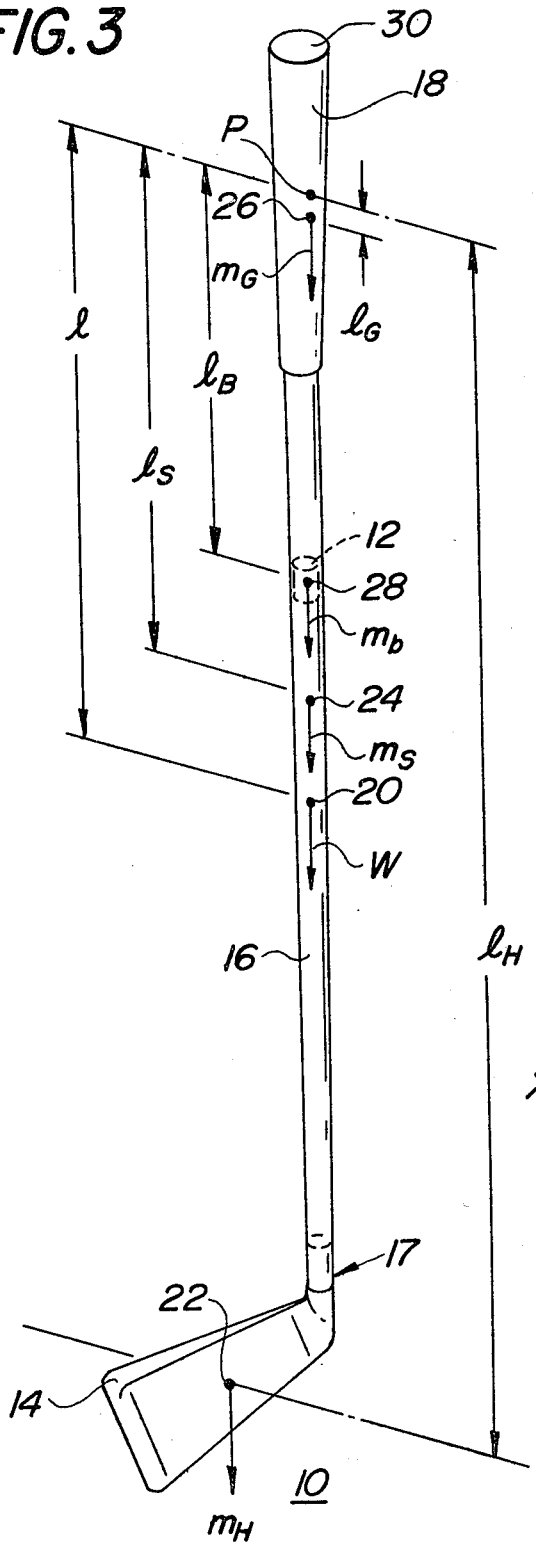
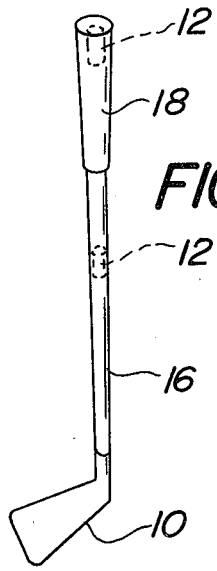
FIG. 4
FIG. 6
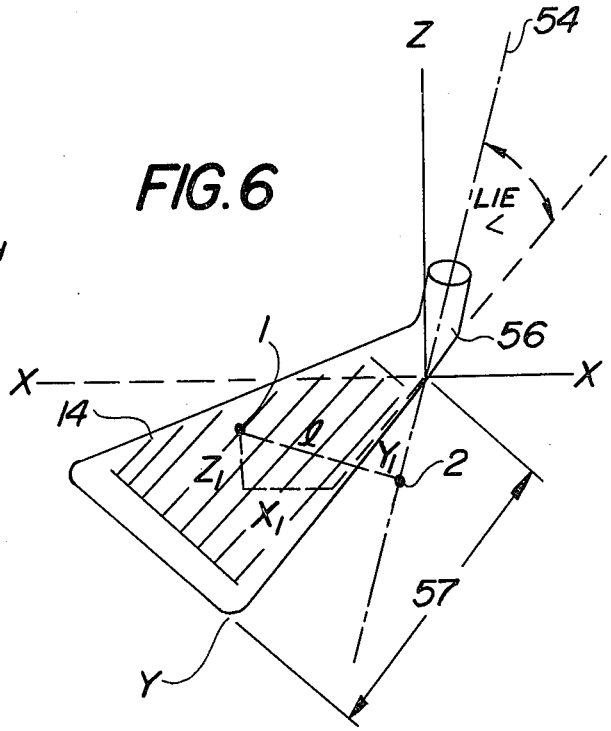

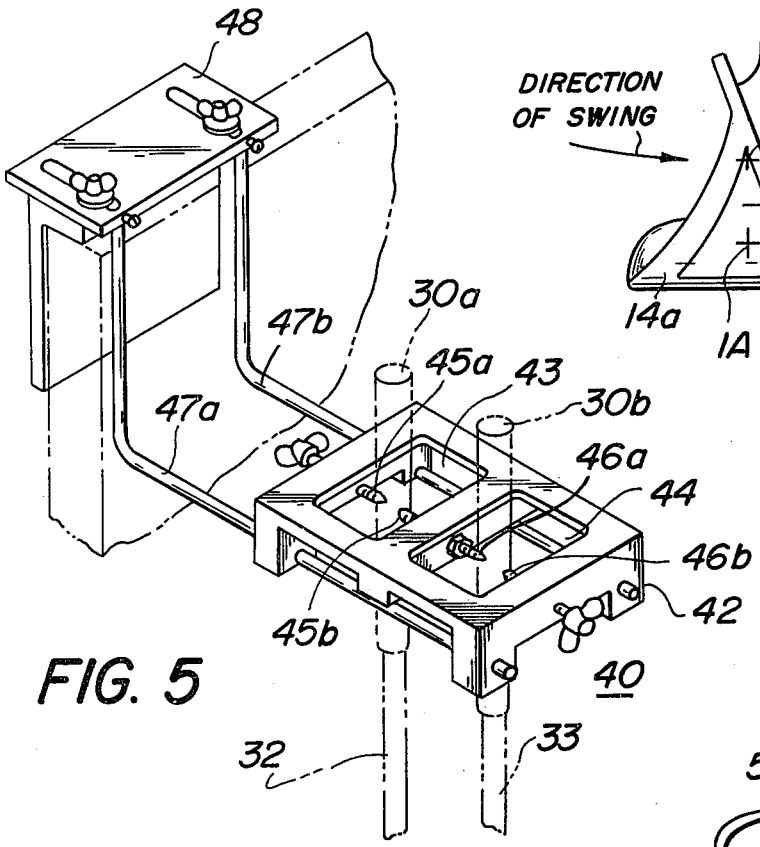
FIG. 5
FIG. 7
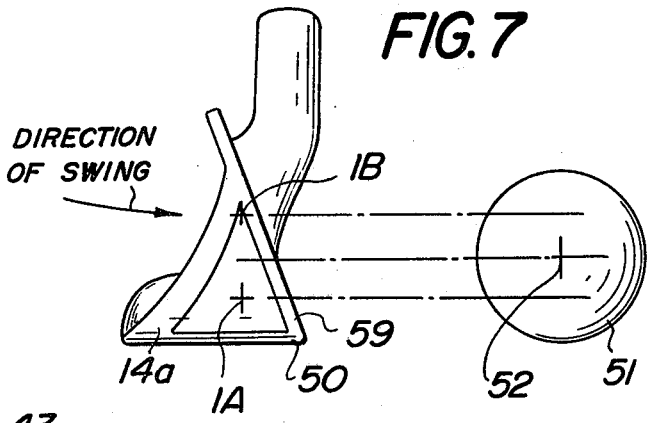
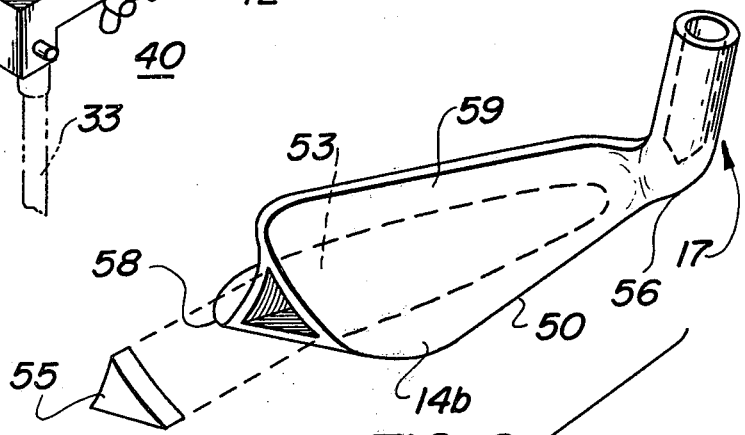
FIG. 8
FIG. 9
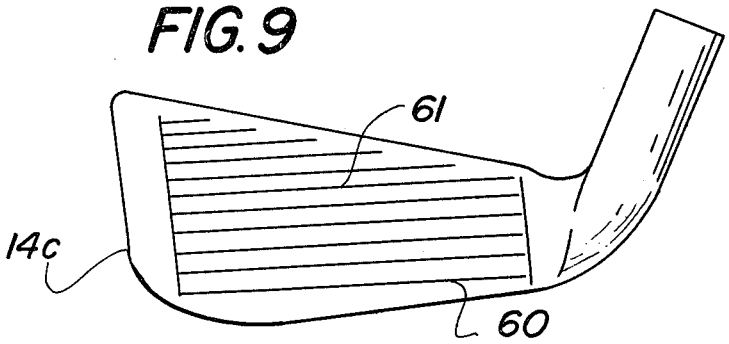

CORRELATED SET OF GOLF CLUBS

BACKGROUND OF THE INVENTION

A. Field of the Invention

This application relates to the field of correlated golf clubs.

B. Prior Art

The matching of golf clubs is well known in the art and is summarized in Cochran and Stobbs, "The Search for the Perfect Swing", Chapter 33, J. B. Lippincott Co., 1968. This text describes the matching of clubs by the traditional swing-weight method and suggests other techniques. The swing-weight technique is a static measurement in which the club maker places the clubs in a swing-weight balance and reads off a particular number depending upon the scale used. The swing-weight is defined as the moment of the club's weight about a point 12 inches from the grip end of the club. In a particular example, a two iron weighs 15 oz. having a balance point 28½ inches from the top end of the shaft. The swing-weight is calculated by multiplying the weight by the distance between the balance point of the club and the 12 inch pivot on the scale. Accordingly, the swing-weight is calculated to be 247½ ounce-inches. This swing-weight technique is described in detail in U.S. Pat. Nos. 1,953,916 and 1,594,801.

In another matching technique the clubs are matched by matching the moment of inertia of the clubs as described, for example, in U.S. Pat. Nos. 3,473,370; 3,698,239 and 3,703,824. In the moment of inertia technique, the golf clubs are typically dynamically balanced by matching the moment of inertia of each club about its center of gravity or about some other pivot a fixed distance from the butt end of each club.

However, both of these prior techniques have left much to be desired since the total human perception is a blend of both static and dynamic perceptions. Portions of the golf swing are relatively static in nature such as the address and the backswing. The golfer perceives messages from the club through his hands corresponding to the weight of the club and the moment about his grip during these essentially static portions of the swing. On the other hand, other portions of the swing such as the downswing are dynamic. Neither static balancing nor dynamic balancing taken as independent parameters achieves the combined objective of providing the player with a uniformity of feel and balance throughout both the dynamic as well as static segments of the golf swing. A reason why dynamic balancing alone is not sufficient is that when a club is dynamically balanced, during the static portion of the swing it will feel heavier or lighter than another since the golfer is also sensitive to the static weight of the club. It has been found that a golfer's subconscious perception of the static weight of the golf club will affect how he swings the club. If golf clubs feel differently to the golfer, there is a tendency on his part to try to swing them differently. This is described for example, in David Williams, "The Science of the Golf Swing" Chapter 10, Pelham Books Ltd., London, 1969.

SUMMARY OF THE INVENTION

A correlated set of golf clubs and method for producing the same in which at least two of the golf clubs have differing lengths and each of the clubs in the set has a shaft with a grip at one end and a clubhead at the other end. Each of the clubs of the set have predetermined physical parameters of the shaft, grip and clubhead and each of the clubs has a predetermined weight distribution over the club. Each of the clubs has substantially the same weight moment about a predetermined pivot and each of the clubs has substantially the same physical pendulum (1) moment of inertia and (2) period of oscillation whereby each of the clubs swings about a preselected swing point under the force of gravity with a substantially equal oscillation period.

BRIEF DESCRIPTION OF THE DRAWINGS

FIGS. 1A–H illustrate a golfer in differing positions starting from the address position through the full backswing position and also in the downswing position near impact;

FIGS. 2A–C illustrate differing positions of a golfer in which several pivots are shown;

FIGS. 3 and 4 illustrate side views of a golf club showing parameters used in calculations according to the invention;

FIG. 5 illustrates a perspective view of a device for swinging two clubs in a pendulum manner;

FIG. 6 illustrates an elevational view of a clubhead showing the differing axes and parameters used in calculating the moment of inertia about the longitudinal axis of the shaft;

FIG. 7 illustrates a plane view of the clubhead showing a substantially low center of gravity;

FIG. 8 illustrates an isometric view of the clubhead showing the hollow and toe triangle; and FIG. 9 illustrates an elevational view of the clubhead having differing scoring.

DETAILED DESCRIPTION

Referring now to FIGS. 1A–G, there is shown a golfer in positions starting with the address position and ending with the full backswing position. In discussing these figures it should be noted that the golf swing occurs in a tilted plane, but for purposes of clarity the discussion to follow is based on the precept that the swing takes place in a plane parallel to the golfer. In the address position, FIG. 1A, the golfer feels primarily the dead weight of the club. As the golfer begins his backswing, FIG. 1B, the golfer begins to feel the moment of the club and in FIG. 1C the golfer is experiencing the full moment of the golf club. As the golfer continues his backswing, his feeling of moment begins to decrease as in FIG. 1D until the club is nominally vertical and the club force acts as a torque on his hands and wrists as shown in FIG. 1E. As the golfer continues his backswing as shown in FIGS. 1F–G, the moment force increases about the golfers hands and wrists.

As a golfer begins the downswing, the dynamic characteristics of the club is increasingly felt as the golf club is accelerated up to high velocity near impact as shown in FIG. 1H. The golfer during the downswing portion of the golf swing perceives the moment of inertia as a resistance to acceleration. The inertia resistance is a negligible factor at address and during the backswing due to the low rotational velocity of the golf club. Accordingly, there has been described how the golf swing shown in FIGS. 1A–G is partly static while the downswing shown in FIG. 1H is mainly dynamic. Thus, the golf swing results in a blend of static and dynamic forces perceived by the golfer during specific segments of the golf swing.

Further analysis indicates the human perceptions during downswing of the golf swing are a complex blend of three separate dynamic characteristics:

(1) The golf club and arms are swung as a unit as in FIG. 2A about a Pivot $P_B$ adjacent the top of the spine near the back of the neck.

(2) Subsequently, while continuing to rotate the club about the pivot $P_B$, the hands and wrists begin to uncock as in FIG. 2B and the golf club begins rotating about the wrist pivot $P_H$ causing increasing force load perception by the arms and hands.

(3) Additionally, during the downswing, the club is rotated approximately 180° from (a) wide open through (b) square at impact to (c) fully closed after impact when taken with respect to the long axis of the golf shaft as shown in FIG. 2C. The moment of inertia of the club about its longitudinal axis is perceived by the golfer as a resistance to the clubhead to being squared.

In view of the foregoing, in order to match, balance or correlate a set of clubs throughout an entire golf swing, each of the clubs in the set must be balanced in combination from both a static point of view and additionally from a dynamic point of view. Specifically, each of the clubs must be correlated with respect to their moment and their moment of inertia. This correlation may be enhanced to differing degrees by additional dynamic and additional static balancing criteria applied to the clubs in the set. As a result, there is produced a correlated set of golf clubs whereby each club in the set exhibits substantially the same static and dynamic force characteristics througout the entire golf swing. This enables the golfer to build a more consistant and repetitive golf swing because it is no longer necessary for the golfer to make individual adjustments in his golfing force-time pattern of swing when he switches from one club to another in the correlated set. In other words, since each of the clubs in the correlated set feels the same to the golfer, the golfer can more readily develop a consistant and repetitive swing, because he no longer has to modify his force-time pattern to compensate for differences in the clubs within this set.

As shown in FIG. 3, a golf club 10 is to be correlated by both static and dynamic matching with the other clubs of a set. Each of the clubs in the set is dynamically correlated so that each of the clubs in the set is matched in accordance with at least one dynamic criteria. Additionally, each of the clubs is statically correlated so that each of the clubs is matched in accordance with at least one static criteria while at the same time maintaining the dynamic correlation. It is to be understood that from solution of the pertinent equations to follow, the dynamic and static correlation may, at least in some cases, be achieved in a simultaneous manner.

Grip 18, clubhead 14 and shaft 16 parameters are defined and a specific balancing weight 12 is precisely positioned in accordance with the following equations. As understood by those skilled in the art, the other golf clubs in the correlated set may have differing lengths, weight and other parameters of individual components. However, the overall length D of each of the correlated clubs remains within the limits of conventional golf clubs.

Definitions:

W = total weight of club 10 in oz.

$m_H$ = weight of clubhead 14 in oz.

$m_S$ = weight of golf shaft 16 in oz.

$m_G$ = weight of golf grip 18 in oz.

$m_B$ = weight of balancing weight 12 in oz.

M = moment of golf club 10 about a pivot point P in inch-oz.

Io = moment of inertia of the entire club 10 about its center of gravity 20 in in.$^2$-oz.

Ip = moment of inertia of entire club 10 about pivot point P in in.$^2$-oz.

l = distance from center of gravity 20 to pivot point P in inches $L_H$ = perpendicular distance from center of gravity 22 of clubhead 14 to pivot point P in inches $L_S$ = distance from center of gravity 24 of golf shaft 16 to pivot point P in inches $L_G$ = distance from center of gravity 26 of golf grip 18 to pivot point P in inches $L_B$ = distance from center of gravity 28 of balance weight 12 to pivot point P in inches $L_{OH}$ = distance from the center of gravity 22 of clubhead 14 to the center of gravity 20 of total club 10

$L_{OS}$ = distance from the center of gravity 24 of shaft 16 to the center of gravity 20 of total club 10

$L_{OG}$ = distance from the center of gravity 26 of golf grip 18 to the center of gravity 20 of total club 10

$L_{OB}$ = distance from the center of gravity 28 of weight 12 to the center of gravity 20 of total club 10

Lo = length of equivalent simple pendulum in inches

D = overall length of golf club 10 in inches

To match the clubs according to moment (M) it is clear that (M) must be the same for each club and:

$$M = m_H l_H + m_S l_S + m_G l_G + m_B l_b \text{ or } M = \sum_{i=1}^{n} m_i l_i \quad (1)$$

where i = subscripts H, S, G, B n = total number of components of golf club

To match the clubs according to moment of inertia ($I_o$), $I_o$ must be the same for each club and:

$$I_o = \sum_{i=1}^{n} (I_{oi} + m_i l_{oi}^2) \quad (2)$$

Thus, the position $l_B$ and weight $m_B$ of the balancing weight 12 may be selected in conjunction with the other parameters to match both the moment and moment of inertia of each club in the correlated set.

The combined dynamic and static matching of each club 10 in the correlated set is enhanced by also matching the clubs according to the total weight (W) of each club. To match the clubs according to total wt (W), W must be the same for each club and:

$$W = m_H + m_S + m_G + m_B \text{ or } W = \sum_{i=1}^{n} m_i \quad (3)$$

The same quality of combined dynamic and static matching of each club in the correlated set can also be achieved by matching the moment of inertia Ip of the clubs about a pivot point P instead of matching Io as in equation 2. Additionally, however, matching is still provided according to equations (1) and (3).

To match the clubs according to moment of inertia (Ip) it is clear that (Ip) must be the same for each club and $$Ip = Io_H + m_H l_H^2 + Io_S + m_S l_S^2 + Io_G + m_G l_G^2 + \quad (4)$$

$$Io_B + m_B l_B^2 \text{ or } Ip = \sum_{i=1}^{n} (Io_i + m_i l_i^2)$$

The reason the foregoing quality of matching is the same will be understood by consideration $$Ip = Io + W l^2 \quad (5)$$

and by definition: $l = M/W$ and therefore $$Ip = Io + (M^2/W) \quad (6)$$

Thus, if Io is matched for each club and M and W are also matched, Ip is matched for each club. And conversely, if Ip, M and W are matched about an axis parallel to the axes of the "hand-wrist" pivot ($P_H$, FIGS. 2A–C) and the "neck-spine" pivot ($P_B$, FIGS. 2A–C) the moment of inertia about these two pivots will also be matched. Thus, four criteria (moment (M), moment of inertia about the center of gravity (Io) of the club, moment of inertia about some pivot (Ip) and the total weight (W)) for static and dynamic balancing of a correlated set of golf clubs will be met if equations (1) and (3), and either (2) or (4) are satisfied.

EXAMPLE I

It is desired to match a 39.5" long two iron to a 38" long six iron with: $W = 16.5$ oz.; M (about a pivot 4" from the butt end of the club) = 378 oz.-in., and a moment of inertia Ip (about same pivot) = 12,257 oz.-in.$^2$.

A typical commercially available golf shaft 16 approximates a long slender cylinder with a center of gravity 46% of its overall length from the butt end of the shaft and weighs 0.111 oz. per inch of length.

A typical commercially available golf grip 18 also approximates a long slender cylinder 12" long with a center of gravity 4" from the butt end of the grip and weighs 1.9 oz.

A golf clubhead 14 possesses a very complex physical geometry but for purposes of this matching it has been found adequate to represent it as a sphere located at the center of gravity of clubhead 14 with a radius of gyration equal to approximately 2.83 in.$^2$. Similarly, balancing weight 14 in shaft 16 is represented as a solid sphere with a radius equal to the inside radius of the shaft, approximately 0.25 in.

38" long six iron specifications $m_H = 9.51$ oz.

$m_S = 37 \times 0.111 = 4.1$ oz. (shaft approximately 1" shorter than overall club length)

$m_G = 1.9$ oz.

$m_b = 0.99$ oz. at 1.4" below pivot 4" from butt end of club $$W = m_H m_S + m_G + m_B = 16.5 \text{ oz.} \quad (7)$$

$$M = m_H l_H + m_S l_S + m_G l_G + m_B l_B = 378 \text{ oz.-in} \quad (8)$$

$$Ip = Io_H + m_H l_H^2 + Io_G + m_G l_G^2 + Io_B + m_B l_B^2 + Io_S + m_S l_S^2 \quad (9)$$

$$Ip = 12{,}257 \text{ oz.-in}^2$$

The matching 39.5" two iron $$W = m_H + 4.27 + 1.9 + m_B = 16.5\text{oz.} \quad (10)$$

$$m_H + m_B = 10.33 \text{ oz.}$$

$$M = (39.5\text{–}4)\, m_H + 4.27 \times (0.46 \times 38.5\text{–}4) + 1.9\,(4\text{—}4) + m_B l_B = 378 \text{ oz.-in.} \quad (11)$$

$$35.5\, m_H + m_B l_B = 319.45 \text{ oz.-in.}$$

$$Ip = 2.83^2 m_H + (39.5\text{–}4)^2 m_H + 1/12 \times 4.27 \times 38.5^2 + (0.46 \times 38.5\text{–}4)^2 \times 4.27 + 1/12 \times 1.9 \times 12^2 + 0.25^2 m_B + m_B l_B^2 = 12{,}257 \text{ oz.-in}^2 \quad (12)$$

$$1268\, m_H + m_B l_B^2 = 10{,}904 \text{ oz.-in.}^2$$

Solving the three equations above for $m_H$, $m_B$ and $l_B$, we find $m_H = 8.41$ oz., $m_B = 1.92$ oz. and $l_B = 11.2''$ below pivot.

Similarly for the other clubs in the correlated set having differing overall lengths, the appropriate head weight, balancing weight and balancing weight location can be found.

It will be understood that the combined dynamic and static matching may be accomplished by choosing only one dynamic criteria, viz, either the moment of inertia Io about the center of gravity of the club or the moment of inertia Ip about a pivot point and additionally only one static criteria may be chosen, viz, either the total weight of the club, W or the moment M of the club about a pivot. Accordingly, a correlated set of golf clubs may be produced when each of the clubs of a set has the same M and each club has the same Io as previously described with respect to equations 1 and 2. Further, a correlated set is produced when each club has the same M and the same Ip; or when each club has the same W and the same Io; or the same W and the same Ip.

In these cases, it is less complex to calculate appropriate combination of balance weights 12 and associated locations of balance weight in a correlated set. When more then one dynamic or more than one static matching criteria is desired as previously described, it is more difficult to find real solutions to the equations. It has been found that when the total weight W, the moment M and the moment of inertia about a pivot Ip are specified, some solutions from equations 1, 3 and 4 may sometimes require negative balance weights 12 for some clubs and possibly nonfeasible locations of balance weights.

In some cases, the long irons (one, two and three irons) in the set may be made too short or the short "irons" (seven, eight and nine irons) in the set may be made too long. If the long irons are too short, insufficient clubhead velocity is generated and a golfer is unable to hit the ball any farther than he can with his mid irons. On the other hand, if the short irons are made too long, the golfer either hits them too far or after additional loft is added to reduce the distance the long short irons hit the ball, the golfer finds he does not have the accuracy with the long short irons that he had with shorter conventionally swing weight matched irons and thus, all the benefits of combined dynamic and static matching are lost.

Thus, it is desirable to have some progressive increase in the length of the club in the correlated set from the nine iron to the two iron. It has been found that as the difference in length between a nine iron and a two iron is increased, the difficulty in finding a reasonable combination of club parameters including balance weight and location which satisfy the matching criteria may also increase.

It has been found that as the total weight specification of the clubs in the correlated set is reduced, it becomes more difficult to find club parameters which satisfy the matching criteria. This is clear since a real grip, shaft and clubhead all must have some actual weight. Then as the total weight specified approaches the inherent weight needed for a grip, shaft and clubhead, less weight is available for use in balance weight 12 and more extreme locations of the balance weight are required.

For example, if a total weight specification of 14.5 oz. had been specified in Example I instead of 16.5 oz. and a conventional steel shaft and rubber grip were contemplated as was done in Example I, there would not be enough weight left over for a balance weight which would match the moment and moment of inertia specifications.

Thus, a "most desirable" or optimized set of specifications for a correlated set of clubs tends to add difficulty in finding the club parameters that satisfy the matching criteria. This is because the specifications are often trying to maximize the feasible difference in length between the shortest and longest clubs in the set and at the same time attempting to minimize the total weight specification while at the same time attempting to meet the largest number of dynamic and static matching criteria.

Another consideration for the correlated set of clubs is as follows: It has been found that for example when a driver (No. 1 wood) is matched to the six iron specification of Example I, the weight of clubhead 14 is sufficiently less than a conventional driver such that the efficiency of the energy transfer from clubhead 14 to the golf ball is lessened. Therefore, an alternative to correlating all woods and irons to one set of criteria is a set whereby all the irons are matched to one set of criteria and all the woods are matched to another set of criteria. For example, the irons might all be matched to industry standard six iron specifications while the woods might be matched to conventional three wood specifications. However, in correlating the entire set of irons to a six iron, the shorter irons, wedges, 9, 8 and 7 may be somewhat more difficult to swing since they are correlated to the six iron. Accordingly, it may be desired to provide a correlated set comprising irons one through six all dynamically and statically correlated to the six iron while the remaining shorter irons are conventionally swing-weight matched. However, for the purpose of definition herein, a correlated set shall be defined as at least two clubs of differing lengths which are dynamically and statically matched in accordance with the defined criteria with any remaining clubs (such as those merely swing-weight matched) not being considered part of the correlated set.

It has also been found desirable in some correlated sets to increase the traditional length of the short irons thus decreasing variations in the angle of the golfers swing-plane and address position as he changes from using one club to another in the correlated set.

As previously described, the balance weight location $L_B$ and its weight $m_B$ may be defined in accordance with equations 10–12. It has been found in examples of correlated golf clubs the balancing weight location may vary anywhere from about the center of gravity 20 of one club to the butt end 30 of another club 10. It will be understood that balancing weight 12 must be secured in position within the tapered hollow shaft 16. In another embodiment the balancing weight may be in the form of a cylinder (not shown) joining two sections of shaft 16 The cylinder would be visible from the outside of club 10 and have a larger outer diameter than that of the shaft sections that is is joining.

The balancing weight 12 within the shaft may be constructed as follows. A rubber or otherwise weighted plug is constructed to fit within the shaft just below the desired weight location. A mixture of weighted shot and adhesive material, for example, epoxy, is then poured on top of the rubber plug and allowed to cure. In another embodiment, a rubber coated weight is placed in the shaft and expanded to a force fit against the interior surface of the shaft at the desired location. Alternatively, the weight may be in the form of a lead expansion bolt and as the lead cylinder expands in its outer diameter, it grips the inner diameter of the shaft.

Manufacture of a correlated set of golf clubs as suggested in Example I can be confirmed by experimental methods. The total weight of the club can be ascertained using a standard balance or scale. The moment of the club may be determined using a traditionally available golf club swing-weight scale and once these two criteria have been met, the moment of inertia of the club may be determined by physically pivoting the club on a set of pivots and measuring the period of its pendulum oscillation. Very precise correlation of the dynamic properties of the club can be determined by pivoting two such clubs in the correlated set in parallel pivots swinging them at the same time and observing over a period of several swings the repetitive equal period of two clubs in the set. Similarly, all clubs in a matched set can be compared to or tested against a master for having the desired dynamic properties.

A suitable swinging device 40 for swinging two clubs in the pendulum manner from each of the respective pivot points is shown in FIG. 5. It will be understood that in accordance with equation 6 that pivot points other than P may be selected. Accordingly, two clubs 32, 33 may be compared by selecting a pivot at the very ends 30*a*, *b* or at some intermediate points as long as both points on both clubs are the same distance from the respective ends.

Device 40 comprises a rectangular housing 42 having a pair of openings 43 and 44. For the pivot points, there are provided two pairs of pointed screws 45*a*, *b* and 46*a*, *b*. One of the screws 45*b*, 46*a* of each of the pairs are fixedly secured to an inner wall of housing 42. The remaining screws 45*a*, 46*b* are threadedly engaged in the inner wall and easily rotatable by means of thumb screws.

Housing 42 is secured in place by means of horizontal rods 47*a*, *b* which are bent upwardly to form a vertical securing section. The ends of rods 47*a*, *b* fixedly engage a rectangular horizontal plate member 48. Member 48 has elongated openings for receiving securement devices which threadedly engage an adjustable clamping plate 49. In this manner, device 40 may be hung from a door filing cabinet or other structure with the structure being clampingly held between clamping plate 49 and the vertical securing section formed by rods 47*a*, *b*.

In this manner with device 40 in place, clubs 32, 33 may be secured at their respective pivot points. Clubs 32, 33 are then swung together in order to compare their periods of oscillation. The plane formed by the shafts of both clubs is used to check out the matching of the dynamic and moment criteria of the clubs. This plane should remain coincident, viz, not change with respect to swing time.

It will also be understood that housing 42 may be adapted to pivot more than two clubs in additional openings thereby to compare further clubs.

The aforementioned swing device 40 can also be used in the manufacturing process to eliminate inaccuracies that arise from simplifications used in equations 1–5, considerations set forth in Example I and particularly the approximations in calculating the moment of inertia of the shaft and golf clubhead. By minor adjustments in the weight distribution such as in the toe weight as later described and length of the finished club, very close correspondence of the dynamic characteristics of a correlated set of clubs can be obtained. In this way, by the use of device 40 in combination with the equations, it is possible to obtain a combined analytic and empirically accurate correlations for the clubs in the set.

Further, when any two clubs are compared in device 40, it will be understood that as the number of swings increases, any differences between the two clubs accumulates. Accordingly, such differences can be adjusted out of the correlated set as previously described by minor adjustments in the length and/or weight distribution as previously described. As presently understood, these empirical adjustments are effective to match the I/m ratio of one club with respect to another club in the correlated set.

FIG. 2C illustrates a manipulation of the golf club by the golfer in the form of rotation about the long axis of the shaft to square the club at impact. The physical effort required to rotate the club in this manner is directly proportional to the moment of intertia of the golf club about the long axis of the shaft.

In a typical correlated set of clubs the grips are similar in size and weight. It is not necessary to consider the moment of inertia of the grip about the shaft axis. The shafts in a correlated set only vary by a few inches in length and cause only a negligible variation in the rotational moment of inertia.

For example, in a correlated set of irons, the shafts might vary 6" in length and since typical shafts weigh in the order of 0.1 oz. per inch the variation in moment of inertia about the shaft axis is only:

$$I = \tfrac{1}{2}\, m\,(r_1^2 + r_2^2) \tag{13}$$

where $r_1$ and $r_2$ are the inside and outside radii of the shaft with typical values of $r_1 = 0.25''$ and $r_2 = 0.28''$ $$Io = \tfrac{1}{2} \times 0.6\,(0.25^2 + 0.28^2) = 0.0423 \text{ oz.-in}^2$$

This is very small compared to the moment of inertia of the golf clubhead and thus can reasonably be ignored in dynamically matching a set of clubs about the longitudinal axis of the shaft.

In a conventional set of irons, the length from the heel 56 to the toe 58 of each clubhead is approximately the same. Since clubheads 14 vary substantially in weight and typically have similar distribution of weight within the clubheads, the moment of inertia of the clubheads about long axis of the shaft 54 differs considerably from club to club, requiring a different effort by the hands and forearms to square the clubface at impact.

In Cochran et al, U.S. Pat. No. 3,722,887, a radius of gyration of the two iron is indicated to be in the range 1.06" to 1.17" while in the nine iron it is 1.13 to 1.24. Taking typical values of 8.5 oz. for a two iron and 10.5 oz. for a nine iron, it can be seen that since $Io = mk^2$ the moment of inertia in a conventional set of correlated golf clubs about their center of gravity varies from 9.55–11.63 oz.-in$^2$ for the two iron to 13.40–16.14 for the nine iron. If we translate from the center of gravity of the clubhead to the long axis of the shaft where the perpendicular distance from the cetner of gravity to shaft axis is approximately the same for all clubs, for example 2" then:

$$2 \text{ Iron } Ip = Io + m_H l^2 = 9.55 + 8.5 \times 2^2 = 43.55 \text{ oz.-in}^2 \tag{14}$$

$$9 \text{ Iron } Ip = Io + m_H l^2 = 13.40 + 10.5 \times 2^2 = 55.40 \text{ oz.in.}^2 \tag{15}$$

In this case 27% more rotational effort is required to square the nine iron than the two iron.

The total weight of the clubheads have already been specified in meeting the aforementioned static and dynamic balancing criteria, therefore, it is necessary to vary other parameters of the clubhead in order to achieve rotational matching of the correlated set about the long axis 54.

While changes in the X and the Z coordinates as shown in FIG. 6, of the center of gravity 1 (the same as c.g. 22 in FIG. 3) effect the rotational balance of a golf club to some extent, the two primary factors used to rotationally balance the club are the overall length 57 of the club from heel to toe and the heel-center-toe weight distribution at the back of the club. The y coordinate of the center of gravity 1 ($Y_1$) is nominally ½ the overall heel-toe length 57 of the club. Thus increasing the overall heel-toe length for lighter clubs has the effect of increasing the moment of inertia about the shaft axis.

In FIG. 6, a coordinate system is selected where the center line of the club shaft is in the X = 0 plane. Then the equation of the shaft centerline is:

$$Z = -\tan \text{lie} < x\, Y \tag{16}$$

and the equation of a line perpendicular to the shaft centerline through point 1 the center of gravity is:

$$(Z - Z_1) = 1/\tan \text{lie}\,(Y - Y_1) \tag{17}$$

at point 2, the shaft centerline and the perpendicular to it from point 1 intersect as follows where subscripts 1 and 2 refer to points 1 and 2 in FIG. 6:

$$Z_2 = -\tan \text{lie} < x\, Y_2 \text{ and} \tag{18}$$

$$Z_2 - Z_1 = 1/\tan \text{lie} < (Y_2 - Y_1)$$

solving for $Z_2$ and $Y_2$ in terms of $Z_1$ and $Y_1$.

$$Z_2 = -\tan \text{lie} \frac{(Y_1 - Z_1 \tan_2 \text{lie} <)}{(\tan \text{lie}) + 1}$$

and $$Y_2 = \frac{Y_1 - Z_1\,(\tan \text{lie} <)}{(\tan \text{lie} <)^2 + 1}$$

The distance between points (1) and (2) is 1 and is given by $$1^2 = (X_2 - X_1)^2 + (Y_2 - Y_1)^2 + (Z_2 - Z_1)^2 \text{ or} \tag{20}$$

$$1^2 = X_1^2 + \left[\frac{Y_1 - Z_1\,(\tan \text{lie} <)}{(\tan \text{lie} <)^2 + 1} - Y_1\right]^2 +$$

-continued $$\left[\frac{\tan \text{lie} < (Y_1 - Z_1 \tan \text{lie})}{(\tan \text{lie} <)^2 + 1} - Z_1\right]^2 \quad (21)$$

EXAMPLE II

A 38" long six iron with a total clubhead weight of 9.51 oz. is selected to have a lie of 57° and the equation 21 becomes $$l^2 = X^2 + 0.703\ Y^2 + 0.914\ YZ + 0.297\ Z^2$$

The six iron is designed to have an $Io = 9.57$ oz.-in$^2$ about an axis parallel to the shaft axis passing through the center of gravity of the clubhead and the center of gravity has corrdinates:

$X = 0.50''$
$Y = 1.67''$
$Z = 0.72''$ $I$ shaft $= 9.57 + 9.51\ (0.50^2) + 0.703(1.67)^2 + 0.914(1.67)\ (0.72) + 0.297(0.72)^2 = 42.50$ oz.-in$^2$ In matching a two iron 39.5" long with a lie angle of 54.75° (a flatter lie for a longer club) and an overall head weight of 8.41 oz. as previously determined, it is found that:

$Io = 10.04$ and center of gravity
$X = 0.44''$
$Y = 1.85''$
$Z = 0.70''$ for a lie angle of 54.75°

$$l^2 = x^2 + 0.667\ y^2 + 0.943\ yZ + 0.334\ Z^2 \text{ and}$$

$I$ shaft $= 10.04 + 8.41 \times 3.86 = 42.50$ oz.-in.$^2$

Similarly, a correlated set of woods may be rotationally matched about shaft axis 54 so that all woods in the set have the same moment of inertia. In many conventional sets of woods, even though the driver (or No. 1 wood) is the longest club with the lightest head in conventional swingweight matching or dynamic and static matching as previously discussed, the larger physical size of the clubhead more than compensates for the lighter weight so the moment of inertia about the shaft axis is 20–40% greater than the 3, 4 or 5 woods. Therefore, it is necessary to reduce l (move center of gravity closer to shaft) to achieve the desired balancing.

Conventional woods have weight added to the wood head underneath the sole plate and this can be used to build correlated sets of woods to a variety of specifications. For example, a golfer who tends to hook his drives (clubhead rotated beyond square at impact) might prefer clubs with a high moment of inertia about the shaft axis while a golfer who tends to slice this drives (clubhead hasn't reached square at impact) might prefer a correlated set of woods with a lower moment of inertia about the shaft axis.

Since many golfers experience difficulty in squaring (rotating) their drivers at impact but have little or no difficulty in squaring their three wood, a correlated set of woods might be dynamically and statically matched to typical three wood specifications.

Conventional irons are often swingweight balanced by adding weight to bottom of the shaft 16 in the neck 17 of the clubhead 19. This has the effect of building a heavier set of irons with no appreciable change in the rotational balance about the shaft axis.

In order to provide for different rotational balancing for different correlated sets of irons a triangular insert 55 has been incorporated in toe area of each iron and weight may be added or removed from both the neck 17 and toe of the irons. Since the toe of the club is a considerable distance from the shaft, relatively small changes in weight at the toe can appreciably affect the rotational balance.

For example, add 0.2 oz. (2.4% increase in weight) to the two iron at $X = 0.44''$, $Y = 3.7''$ and $Z = 0.70''$ $\Delta Is = 0.2\ (0.44^2 + 0.667 \times 3.7^2 + 0.943 \times 3.7 \times 0.7 + 0.334 \times 0.7^2)$ $\Delta Is = 2.39$ oz.-in$^2$ (5.6% increase)

If 0.2 oz. is also removed from the shaft hole, a 5.6% increase in the moment of inertia about the shaft is obtained with no increase in weight.

Thus the use of a toe insert 55 facilitates fine adjustment of rotational balance of the clubs in a correlated set and permits the construction of correlated sets with different rotational balance characteristics.

Additional considerations enter into the design of a correlated set of golf clubs. As is customary with all matched sets, it is desirable to maintain a correlated visual appearance among the clubs in a set. In addition the "sweet spot" (center of gravity 22, FIG. 3) should be located near the center of the striking face and Io. The moment of inertia of the clubhead about its own center of gravity is maximized by positioning as much clubhead weight as is practical in the heel and toe of the club. This is a well established design principle designed to minimize the amount of rotation of the clubhead when it is struck by an off center blow from the golf ball. The technique for achieving this objective is the construction of a clubhead having a hollow portion 53 as illustrated in FIG. 8 where the addition of the toe triangle section 55 or plug permits a significant heel-toe weight distribution in clubhead **14*b*. It will be understood that additional weight can be added as needed within hollow portion 53. For example, a predetermined amount of a mixture of lead or metal shot and an adhesive, such as epoxy, may be poured within hollow portion 53. Toe triangle section 55 is then inserted in place and club 14*a* positional with section 55 down and substantially horizontal. In this way, the epoxy is allowed to cure and form an additional weighing layer on triangle section 55 as well as permanently attaching section 55** in place.

In constructing hollow portion 53 it has been found preferable to provide striking face 59 with a substantially constant cross-sectional thickness as best shown in FIG. 7.

Another consideration in the design of this correlated set of golf clubs is to build a clubhead in which it is easy for the golfer to get the golf ball high in the air. One method of enhancing this characteristic of a golf club for a given angle of striking face 59 is to locate the center of gravity of the clubhead as low as possible in the Z coordinate direction. As illustrated in FIG. 7, if the center of gravity is sufficiently low in the clubhead as in location 1A, this causes a counter-clockwise rotation of clubhead **14*a* during its collision with the golf ball adding effective loft to the golf club. Similarly, if the center of gravity of the clubhead 14*a* were located above the center of gravity of the golf ball as in 1B in FIG. 7 the opposite rotation would take place and the tendency would exist to reduce the effective loft of the golf club during impact with the golf ball. A wide "sweep" sole 50** is provided with each club in the correlated set to lower the center of gravity of each clubhead thus increasing the effective loft of the club at impact without significant sacrifice in the distance of carry of the golf ball.

In view of the foregoing, it will now be understood that a dynamic and static correlated set of golf clubs may be achieved by choosing only one dynamic criteria plus only one static criteria as previously described. Further an enhanced correlated set may be achieved as previously described if each club in the set matches the criteria of equations 1 and 3 and either 2 or 4. This correlated set may be provided with enhanced feel and playability (as those terms are used in the art) by the addition of one or more of the following criteria.

(a) the moment of inertia about axis 54 of each club is the same, (b) a hollow 53 clubhead 14*b*, (c) a low center of gravity 1A in clubhead 14*a*.

Further, in a correlated set, it has been found that particularly with respect to long irons and due to the positioning of the balance weight, the center of percussion has been raised further above the clubhead as compared with swingweighted clubs. Therefore, in order to improve the golfer's feel at impact with the ball, it has been found advantageous to provide hollow section 53 in clubhead 14*b*. It is believed that this improved feel results from the hollow section acting as a shock absorber or as a vibration damper.

The first phase of the collision between a golf clubhead and a golf ball results in compression of the golf ball against the striking face of the clubhead. In the second phase of this collision, the compressed ball slides up the striking face of the clubhead some distance developing backspin. In the last stage of the collision, the ball decompresses and leaves the clubhead with some amount of forward velocity and backspin.

As shown in FIG. 9, the irons in the correlated set have been designed to have wider frictional score lines in the normal first phase collision area 60 of clubhead 14*c* and closer spaced scoring lines in the normal sliding second phase contact area 61 of clubhead 14*c*. In this manner, there is improved the efficiency of the collision in the first phase and the amount of backspin imparted to the golf ball during the second phase.

What is claimed is:

1. A method of producing a correlated set of golf clubs, at least two of said golf clubs having differing lengths and each of said golf clubs having an extended shaft with a clubhead and a grip on opposing ends thereof, including the steps of (a) establishing predetermined weight distributions over each of the clubs in the set, (b) establishing predetermined weight moment values for said clubs in said set, and (c) establishing predetermined physical pendulum (1) moment of inertia and (2) period of oscillation values for said clubs in said set and providing a ratio of the moment of inertia value to the weight moment value for each club which is substantially equal to that ratio for each of the other clubs in said set so that each of the clubs swings about a preselected swing point under the force of gravity with a substantially equal physical pendulum period of oscillation.

2. The method of claim 1 in which there is provided the further step of matching the weight of each club in the set so that each club has substantially the same total weight.

3. A method of producing a correlated set of golf clubs in which at least two of said golf clubs have differing lengths and each of the clubs in the set has a shaft with a grip to one end and a clubhead at the other end which comprises the steps of (a) providing a predetermined weight distribution over each club, (b) statically correlating each of the clubs in the set so that each of the clubs in the set has substantially the same weight moment about a predetermined pivot, and (c) dynamically correlating each of the clubs in the set so that while maintaining the same weight moment each of the clubs in the set has substantially the same physical pendulum (1) moment of inertia and (2) period of oscillation, whereby each club swings about a preselected swing point under the force of gravity with a substantially equal physical pendulum period of oscillation.

4. The method of claim 3 in which said preselected swing point is the same distance from a butt end of each club.

5. The method of claim 4 in which step (b) includes matching the weight of each club in the set so that each club has substantially the same total weight.

6. The method of claim 5 in which step (c) includes correlating each club to have substantially the same moment of inertia taken about said predetermined pivot which predetermined pivot is approximately the same distance from a butt end of each club.

7. The method of claim 6 in which step (a) includes positioning balance weight means at predetermined locations between the butt end and approximately the center of gravity of said clubs to maintain for each club said substantially same weight moment and moment of inertia.

8. The method of claim 7 in which there is provided the further step of adjusting the weights of the clubheads of the clubs to maintain for each club said substantially same moment of inertia while maintaining said substantially same weight moment.

9. The method of claim 8 in which there is provided the further step of matching each of the clubs in the set so that each club has substantially the same moment of inertia about the longitudinal axis of the shaft.

10. The method of claim 9 in which there is provided the further step of providing each of the clubs in the set with a substantially hollow clubhead.

11. The method of claim 10 in which there is provided the further step of locating the center of gravity of the clubhead as low as possible in the Z coordinate direction.

12. The method of claim 6 in which there is provided the further step of (d) varying the lengths of said clubs in a predetermined manner to maintain for each club said substantially same weight moment and moment of inertia.

13. The method of claim 5 in which the correlated set comprises more than two golf clubs having differing lengths.

14. A correlated set of golf clubs in which at least two of the golf clubs have differing lengths and each of the clubs has a shaft with a grip at one end and a clubhead at the other end comprising each of the clubs in the set having predetermined physical parameters of the shaft, grip and clubhead with each of the clubs having a predetermined weight distribution over the club, each of the clubs having predetermined weight moment values and each of the clubs having predetermined physical pendulum (1) moment of inertia and (2) period of oscillation values, the ratio of the moment of inertia to the weight moment of each club being substantially equal to that ratio for each of the other clubs in the set whereby each of the clubs swings about a preselected swing point under the force of gravity with a substantially equal physical pendulum period of oscillation.

15. The correlated set of golf clubs of claim 14 in which each of the clubs has the same total weight.

16. A correlated set of more than two golf clubs in which each of the golf clubs in the set have differing lengths and each has a shaft with a grip at one end and a clubhead at the other end comprising each of the clubs in the set having predetermined physical parmaters of the shaft, grip and clubhead with each of the clubs having substantially the same weight moment about a predetermined pivot and each of the clubs having substantially the same physical pendulum (1) moment of inertia and (2) period of oscillation whereby each of the clubs swings about a preselected swing point under the force of gravity with a substantially equal physical pendulum period of oscillation.

17. The correlated set of golf clubs of claim 11 in which said preselected swing point is the same distance from a butt end of each club.

18. The correlated set of golf clubs of claim 17 in which each of the clubs has substantially the same total weight.

19. The correlated set of golf clubs of claim 18 in which each of the clubs has substantially the same moment of inertia taken about said predetermined pivot which is approximately the same distance from a butt end of each club.

20. The correlated set of golf clubs of claim 16 in which each of the clubs has a predetermined weight distribution over the club.

21. A correlated set of golf clubs in which at least two of the golf clubs have differing lengths and each of the clubs in the set have a shaft with a grip at one end and a clubhead at the other end comprising each of the clubs of the set having predetermined physical parameters of the shaft, grip and clubhead with each of the clubs having a predetermined weight distribution over the club, each of the clubs having substantially the same weight moment about a predetermined pivot and each of the clubs having substantially the same physical pendulum (1) moment of inertia and (2) period of oscillation whereby each of the clubs swings about a preselected swing point under the force of gravity with a substantially equal oscillation period.

22. The correlated set of golf clubs of claim 21 in which each of the clubs has substantially the same total weight.

23. The correlated set of golf clubs of claim 22 in which said preselected swing point is the same distance from a butt end of each club.

24. The correlated set of golf clubs of claim 23 in which each of the clubs has substantially the same moment of inertia taken about said predetermined pivot which is approximately the same distance from a butt end of each club.

25. The correlated set of golf clubs of claim 24 in which said predetermined weight distribution includes balance weight means positioned at predetermined locations over the clubs to maintain for each club said substantially same weight moment and moment of inertia.

26. The correlated set of golf clubs of claim 25 in which said balance weight means includes balance weights secured within shafts of the clubs in the set.

27. The correlated set of golf clubs of claim 24 in which the set comprises more than two golf clubs having differing lengths.

* * * * *

UNITED STATES PATENT OFFICE

CERTIFICATE OF CORRECTION

PATENT NO. : 4,128,242

DATED : December 5, 1978

INVENTOR(S) : Vance V. Elkins, Jr.

It is certified that error appears in the above-identified patent and that said Letters Patent are hereby corrected as shown below:

In claim 3, line 4, change "to" to --at--.

In claim 17, line 1, change "11" to --16--.

Signed and Sealed this

*Eleventh* Day of *March 1980*

[SEAL]

*Attest:*

SIDNEY A. DIAMOND

*Attesting Officer*

*Commissioner of Patents and Trademarks*